United States Patent [19]

Ninomiya et al.

[11] 4,448,162

[45] May 15, 1984

[54] OPTIMUM CONTROL FOR INTERNAL COMBUSTION ENGINES

[75] Inventors: Masakazu Ninomiya; Atsushi Suzuki, both of Kariya, Japan

[73] Assignee: Nippondenso Co., Ltd., Kariya, Japan

[21] Appl. No.: 386,097

[22] Filed: Jun. 7, 1982

[30] Foreign Application Priority Data

Jun. 8, 1981 [JP] Japan ..... 56-87703

[51] Int. Cl.[3] ..... F02D 5/04; F02P 5/08; F02B 3/04

[52] U.S. Cl. ..... 123/419; 123/418

[58] Field of Search ..... 123/418, 416, 417, 419; 304/442, 431.05, 431.04, 158

[56] References Cited

U.S. PATENT DOCUMENTS

| | | | |
|---|---|---|---|
| 4,026,251 | 5/1977 | Schweitzer et al. | 123/419 |
| 4,092,955 | 6/1978 | Reddy | 123/419 |
| 4,258,684 | 3/1981 | Schira | 123/418 |
| 4,343,278 | 8/1982 | Asano | 123/419 |
| 4,373,487 | 2/1983 | Komurosaki et al. | 123/418 |
| 4,374,510 | 2/1983 | Komurosaki et al. | 123/418 |
| 4,379,333 | 4/1983 | Ninomiya et al. | 123/419 |
| 4,380,800 | 4/1983 | Wilkenson | 123/419 |

*Primary Examiner*—Raymond A. Nelli

*Attorney, Agent, or Firm*—Cushman, Darby & Cushman

[57] ABSTRACT

In the optimum control for an internal combustion engine wherein the engine is operated by dithering a value of a selected one of engine operating control variables from a value of the selected control variable which is obtained by calculation in accordance with detected values of operating parameters of the engine, and a direction of improving either one of a fuel consumption rate and an output of the engine is decided on the basis of a detected change of an engine operating condition, thereby correcting the calculated value of the selected control variable, during the time period of each dithered engine operation, an engine speed is detected two or more times and used for deciding the direction of a change of the engine speed, thereby providing an improved optimum control method and apparatus for internal combustion engines capable of preventing undesired correction control of the control variable from being effected in response to a change of the engine speed caused by any factor of disturbance.

8 Claims, 18 Drawing Figures

FIG. 11

ENGINE SPEED Ne →

| Pm \ Ne | --- | --- | r-2 | r-1 | r | r+1 | r+2 | --- | --- |
|---|---|---|---|---|---|---|---|---|---|
| --- | | | | | | | | | |
| --- | | | | | | | | | |
| p-1 | | | $\theta_B(p-1,r-2)$ | $\theta_B(p-1,r-1)$ | $\theta_B(p-1,r)$ | $\theta_B(p-1,r+1)$ | $\theta_B(p-1,r+2)$ | | |
| p | | | $\theta_B(p,r-2)$ | $\theta_B(p,r-1)$ | $\theta_B(p,r)$ | $\theta_B(p,r+1)$ | $\theta_B(p,r+2)$ | | |
| p+1 | | | $\theta_B(p+1,r-2)$ | $\theta_B(p+1,r-1)$ | $\theta_B(p+1,r)$ | $\theta_B(p+1,r+1)$ | $\theta_B(p+1,r+2)$ | | |
| --- | | | | | | | | | |
| --- | | | | | | | | | |

INTAKE PRESSURE Pm →

OPTIMUM CONTROL FOR INTERNAL COMBUSTION ENGINES

BACKGROUND OF THE INVENTION

1. Field of the Invention

The present invention relates to an optimum control method and apparatus for internal combustion engines, which feedback-control the ignition timing, air-fuel ratio and fuel supply quantity of an engine so as to improve the output and fuel consumption rate of the engine.

2. Description of the Prior Art

The ignition timing for most internal combustion engines is adjusted, unless there exists any special reason such as the requirements from knocking or exhaust gas characteristic, in accordance with the operating conditions of the engine, namely, on the basis of an engine speed, intake pressure, etc., so as to simultaneously attain a maximum output and a minimum fuel consumption rate for the engine. However, the effect of these prior art methods is limited and they inevitably suffer some losses in both engine output and fuel consumption rate. For instance, such losses are caused by such factors as the variations in performance among manufactured engines, the variations in ignition timing correction, the changes in ambient conditions, etc.

Techniques have been devised for feedback-controlling the ignition timing of an engine so as to eliminate such losses and provide a maximum engine output. In an example of these ignition timing feedback control techniques, the ignition timing of an engine is controlled at an optimum ignition timing which provides a maximum engine torque by selecting at least two ignition timings which are different from each other and are in the vicinity of but apart by a given ignition angle from a calculated ignition timing obtained in accordance with the operating conditions of the engine, operating the engine at the at least two selected ignition timings alternately for a given time period, detecting a signal indicative of the engine speed when the engine is operated at each of the at least two ignition timings, comparing the engine speed signals with one another which have been obtained at at least three successive operating points during the operation of the engine at each of the at least two selected ignition timings, deciding whether the calculated ignition timing is advanced or retarded from an optimum ignition timing (the minimum spark advance for best torque or MBT) and then correcting the calculated ignition timing in accordance with the result of the decision.

In accordance with this technique in which a change in the output is determined on the basis of a change in the engine speed, although the engine speed varies naturally due to various factors, it is possible to discriminate whether the actual change in the engine speed is due to the variation of the ignition timing or any other external factor (e.g., an accelerator pedal operation) and to prevent erroneous correction control of the ignition timing in a direction opposite to the optimum ignition timing by interrupting the ignition timing correction during acceleration and deceleration periods, slope ascending and desceding periods, etc.

With the above-described prior art control technique, the direction toward an optimum ignition timing can be decided without any difficulty in cases where the difference between a calculated ignition timing and the optimum ignition timing is sufficiently large. However, the smaller the difference becomes, the more difficult it becomes to decide whether an engine speed change is due to a change of the ignition timing or any other factors such as variations in the air-fuel ratio and the flame propagation speed in respective combustions occurring in the engine, etc.

As a result, when a calculated ignition timing comes near the optimum ignition timing, the ignition timing may be corrected in response to the detection of a change of the engine speed due to such any other factors in spite that there is no necessity of making any further correction.

In the description to follow, the operation of intentionally varying a control variable for controlling the operation of the engine and deciding the resulting change in the operating condition thereby to effect the optimum control of the engine is referred to as "dither" and the period of time during which the dither is effected is referred to as a "dither period". Also, an amount of change of the control variable for effecting the dither is referred to as a "dither quantity".

Further, an internal combustion engine is hereinafter simply referred to as an engine.

The present invention has been made with a view to solving the foregoing problems in the prior art.

SUMMARY OF THE INVENTION

It is an object of the present invention to provide an optimum control method and apparatus for an internal combustion engine in which engine speeds are measured twice at respective different times during each dither period and the measured engine speeds are compared and decided, and further an engine speed change (surge) during each advance step or retard step in the dithering operation is taken into consideration, thereby preventing any undesired correction of a control variable in the vicinity of an optimum value thereof.

It is another object of the present invention to provide an optimum control method and apparatus for an internal combustion engine in which, even if the comparison and decision of engine speeds should establish a positive or negative correction condition, the correction is effected only when the amount of the change of the engine speed is greater than a predetermined value, thereby preventing any undesired correction of a control variable in the vicinity of an optimum value thereof.

BRIEF DESCRIPTION OF THE DRAWINGS

FIG. 11 shows a data map of basic ignition angles stored in the RAM shown in FIG. 2.

In the drawings, like reference numerals and symbols refer to like parts or items.

DESCRIPTION OF THE PREFERRED EMBODIMENTS

An optimum control method and apparatus for an internal combustion engine of this invention which use the ignition timing as a control variable for attaining a maximum engine torque will now be described with reference to the embodiments shown in the accompanying drawings.

Figure 1:
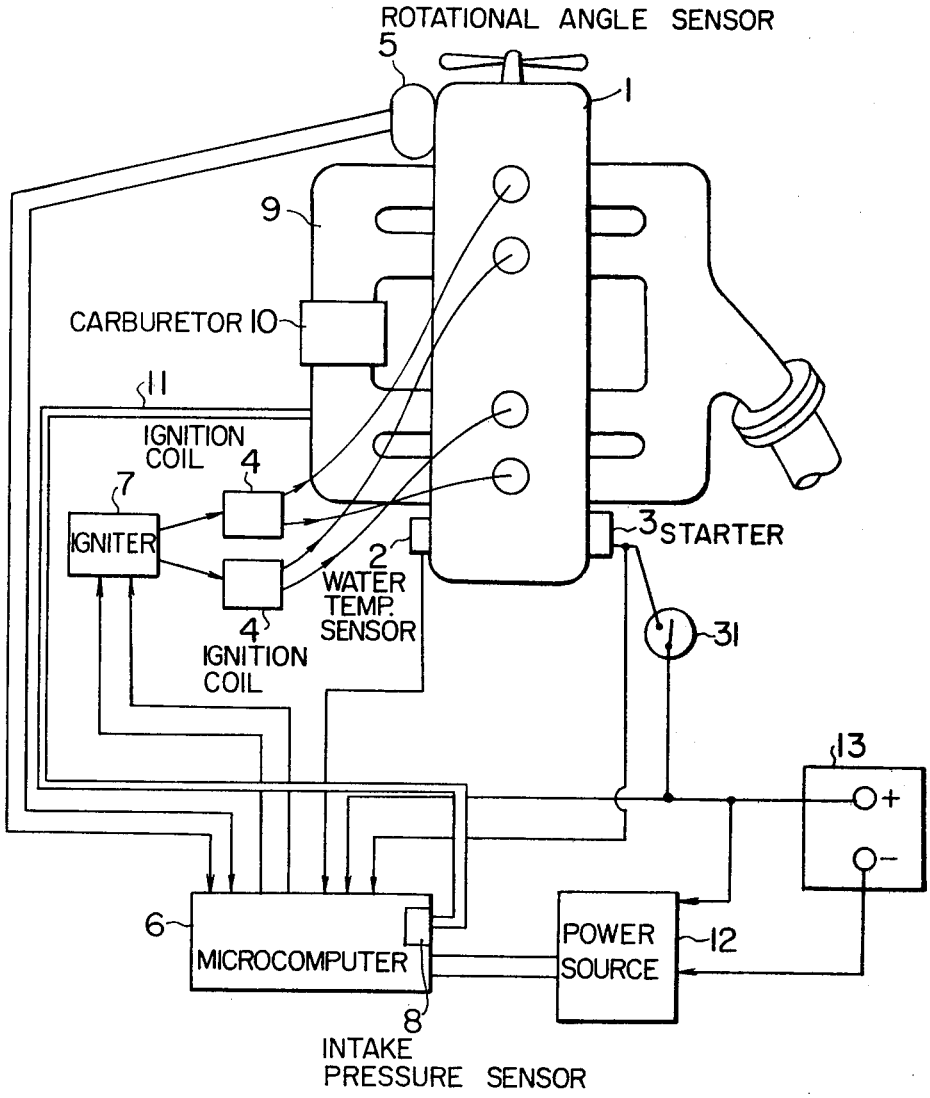
FIG. 1 is a block diagram showing the constructon of an example of an ignition timing control apparatus used for effecting optimum control of the ignition timing of an engine according to this invention.

In FIG. 1, reference numeral 1 designates a four-cylinder, four-cycle engine, and 2 a water temperature sensor for detecting the temperature of the engine cooling water. Numeral 3 designates a starter, and 31 a starter switch. Numeral 5 designates a rotational angle sensor for detecting the crank angle of the engine 1, which generates a top dead center (TDC) signal when the TDC position is reached during the rotation of the engine 1 and which generates a rotational angle signal at every rotation through a given crank angle obtained by equally dividing the angle of one engine rotation (30° crank angle is used in this embodiment and all angles in the following description will be given in terms of crank angle degrees). Numeral 6 designates a microcomputer, 10 a carburetor, and 8 an intake pressure sensor incorporated in the microcomputer 6 for measuring the pressure within an intake manifold 9 which is transmitted to the pressure inlet port of the pressure sensor 8 by way of a pipe line 11. Numerals 4 and 7 designate ignition devices. The present embodiment uses a distributorless ignition system using two ignition coils, in which numeral 4 designates ignition coils and numeral 7 designates an igniter.

The microcomputer 6 computes the engine speed from the time interval between the rotational angle signals generated from the rotational angle sensor 5 and also computes the intake pressure from the output voltage of the pressure sensor 8, thereby measuring the operating condition of the engine 1 and then controlling the ignition timing. Also, in order to control the ignition timing at an ignition angle specified for the start of the engine, the voltage supplied to the starter 3 through the starter switch 31 is applied as a starter signal to the microcomputer 6. In addition, the battery voltage is applied as a battery voltage signal to the microcomputer 6 so as to vary the energizing current duration of the ignition coils 4 in accordance with the battery voltage. Numeral 12 designates a power source for generating the voltage required by the microcomputer 6 from the voltage of a battery 13 mounted on the vehicle.

Figure 2:
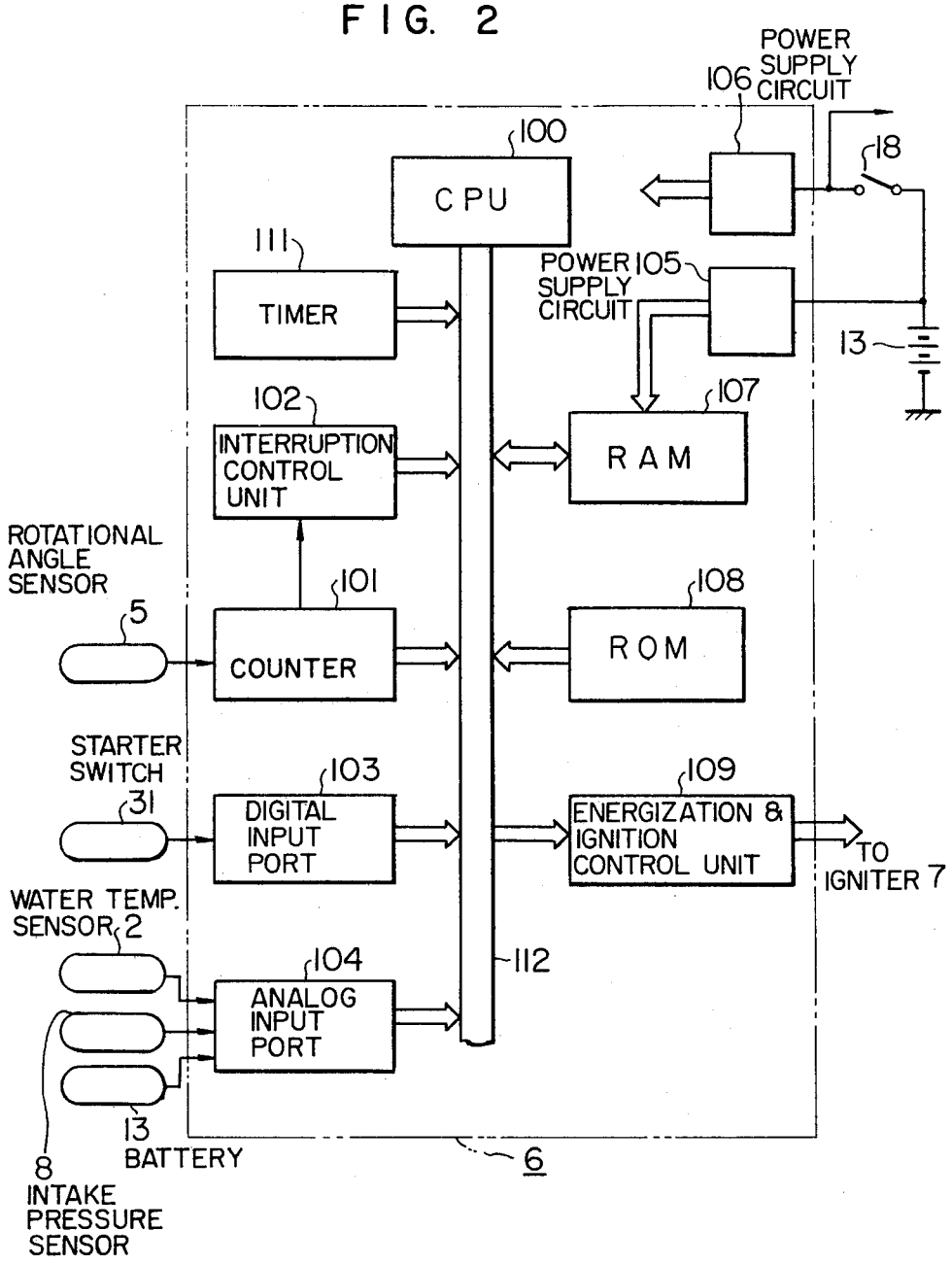
FIG. 2 is a block diagram showing the construction of the computer shown in FIG. 1.

The construction of the microcomputer 6 will now be described in detail with reference to FIG. 2. Numeral 100 designates a microprocessor (CPU) for computing the ignition timing, and 101 a counter responsive to the signals from the rotational angle sensor 5 for counting the number of the engine rotation. The counter 101 also applies an interruption command signal to an interruption control unit 102 in synchronism with a predetermined crank angle. When the interruption control unit 102 receives the interruption command signal, the unit 102 applies an interruption signal to the CPU 100 by way of a common bus 112. Numeral 103 designates a digital input port used for inputting a logical signal, namely, the input voltage signal applied through the starter switch 31 which shows that the starter 3 is in operation. Numeral 104 designates an analog input port having the function of subjecting the signals from the water temperature sensor 2, the intake pressure sensor 8 and the battery 13 to analog-to-digital (A/D) conversion and successively inputting the digital data into the CPU 100. The output data from the units 101, 102, 103 and 104 are transmitted to the CPU 100 via the common bus 112.

Numeral 105 designates a power supply circuit for supplying electric power to a temporary memory unit or RAM 107 which will be described later. Numeral 18 designates a key switch, and the power supply circuit 105 is connected to the battery 13 directly but not via the key switch 18. A power supply circuit 106 supplies electric power to the elements other than the RAM 107. The RAM 107 is a temporary memory unit which is used for temporarily storing information data during the processing of a program. The RAM 107 is a nonvolatile memory so constructed that it is always supplied with electric power independently of the state of the key switch 18 thereby to prevent its stored contents from being lost even when the key switch 18 is turned off and the engine stops operating. Numeral 108 designates a read-only memory (ROM) for storing the program, various constants, etc. Numeral 109 designates an energization (dwell) and ignition control unit comprising a down counter including a register and operating as an energization (dwell) and ignition timing controlling counter, which converts digital signals indicative of the igniter energization time and the ignition timing computed by the CPU 100 to output signals for acutally controlling the igniter 7. Numeral 111 designates a timer for measuring the elapsed time and transmitting the result of its measurement to the CPU 100.

The rotation counter 101 counts 8 μs clock pulses and measures the engine speed from the count value of the 8 μs clock pulses in response to the output of the rotational angle sensor 5 once for every half rotation of the engine, thereby supplying an interruption command signal to the interruption control unit 102 at a predetermined angle. In response to the interruption command signal, the interruption control unit 102 generates an interruption signal, which is supplied to the CPU 100 causing it to execute an interruption processing routine for computing the ignition timing.

Figure 3:
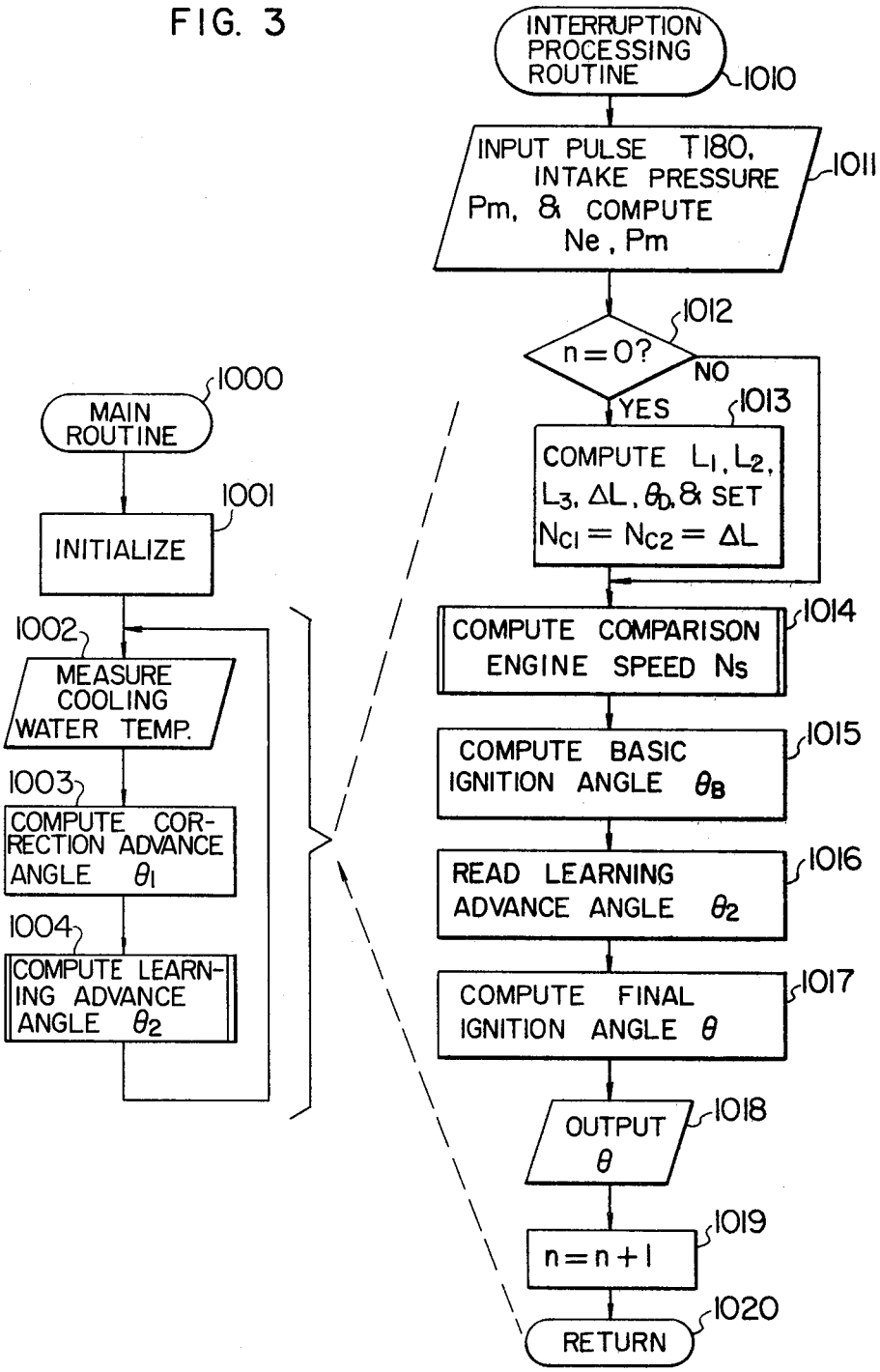
FIGS. 3 to 5 show flow charts for the computation procedure of the computer shown in FIG. 2.

FIG. 3 is a simplified flow chart showing the computation procedure of the CPU 100, and the function of the CPU 100 as well as the operation of the apparatus as a whole will now be described with reference to this flow chart.

When the key switch 18 and the satarter switch 31 are turned on to start the engine, a step 1000 starts the processing of the main routine, and then a step 1001 effects the initialization. A step 1002 reads in a digital value indicative of the water temperature from the analog input port 104. A step 1003 computes from the water temperature data a correction advance angle $\theta_1$ for correcting a basic advance $\theta_B$ (shown in FIG. 11), which will be described later, and stores the result in the RAM 107. A step 1004 performs addition and substraction to compute a learning advance angle $\theta_2$, which will also be described later, for correcting the basic advance angle $\theta_B$ and stores the result in the RAM 107.

Figure 4:
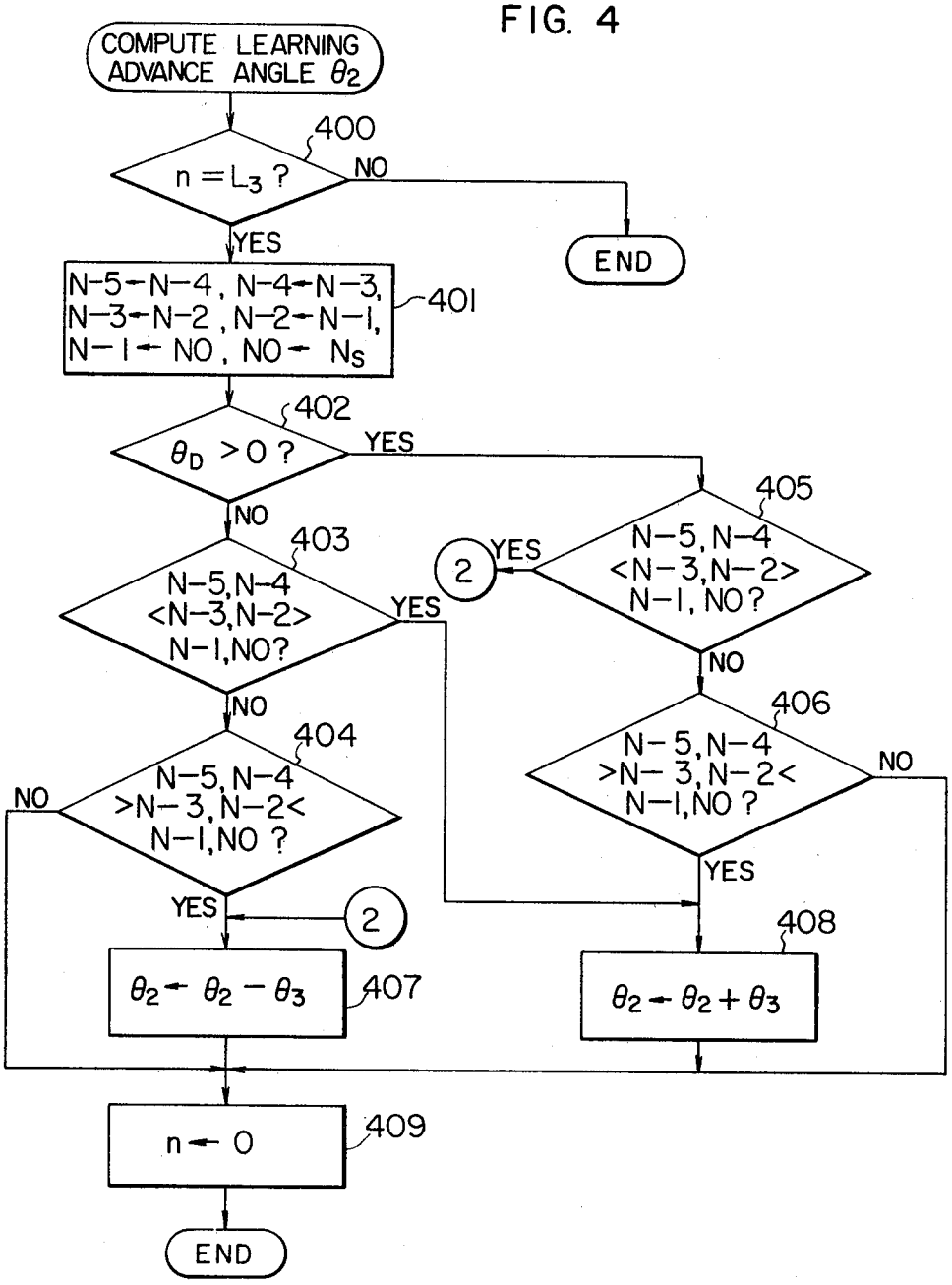

FIG. 4 shows a detailed flow chart for the step 1004 for correcting and storing the learning advance angle $\theta_2$, that is, performing the processing on the learning advance angle $\theta_2$.

Figure 12A:
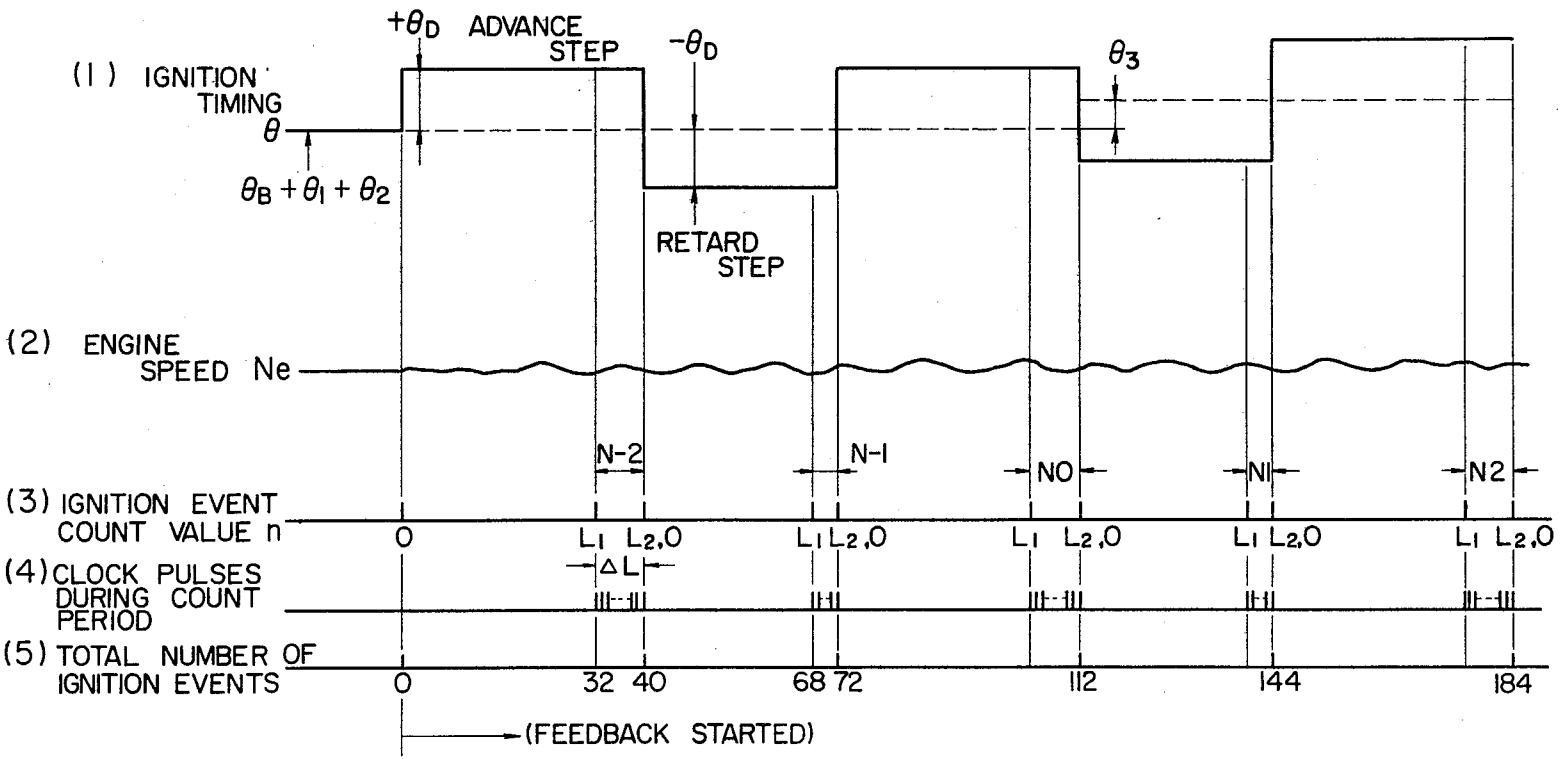
FIG. 12A is a characteristic diagram showing an example of the change with time of the operating condition of the engine subjected to the control of the ignition timing at an optimum value according to the prior art.
Figure 12B:
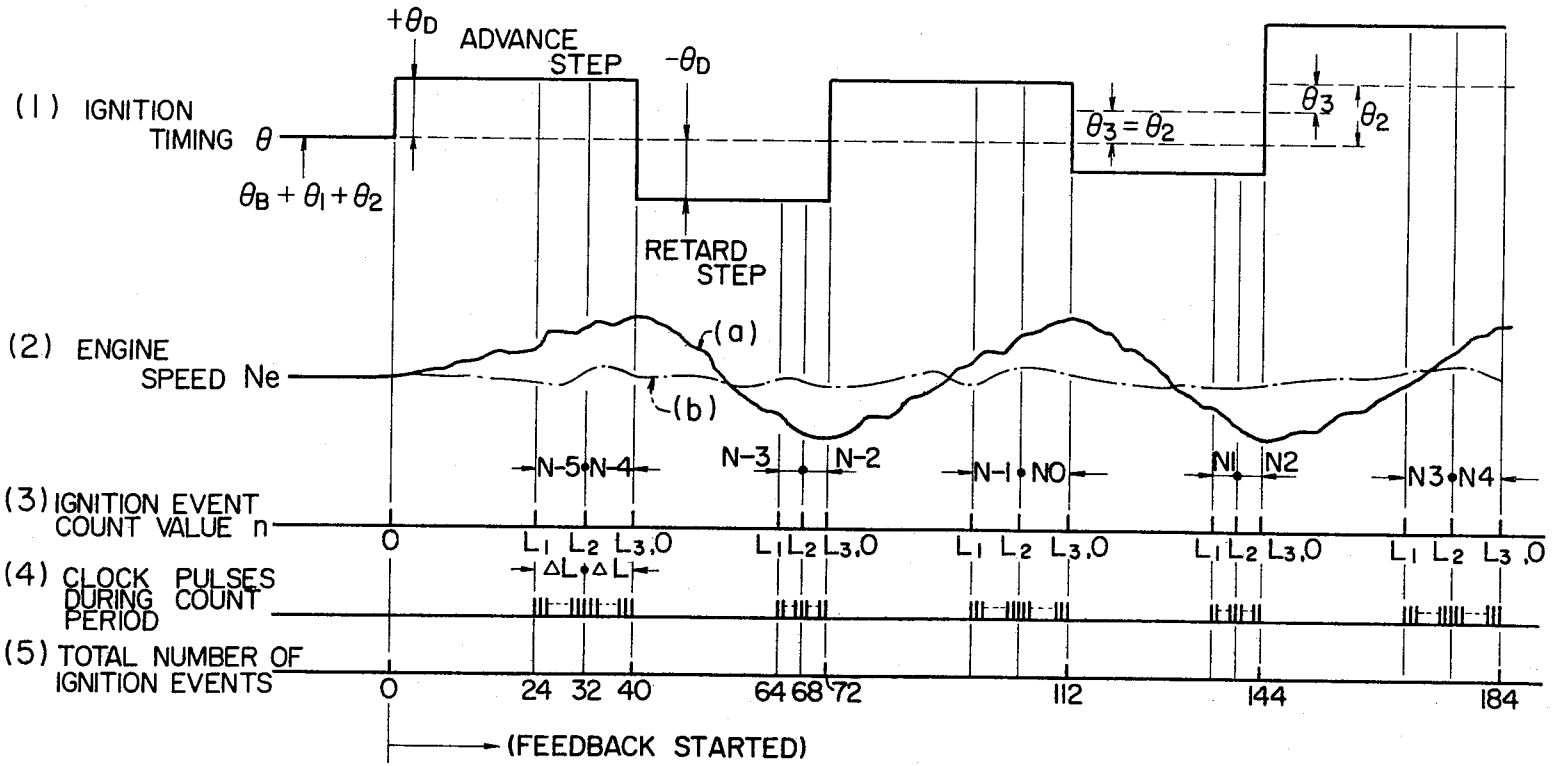
FIG. 12B is a characteristic diagram showing an example of the change with time of the operating condition of the engine subjected to the control of the ignition timing at an optimum value according to the present invention.

In accordance with the embodiment of this invention, as will be seen from FIG. 12B illustrating the embodiment of this invention, engine speed indicative data are obtained twice within each of the dither periods, during which the ignition timing is dithered in an advance (positive) direction or a retard (negative) direction, and the data obtained through three successive dithering operations are used. In other words, a total of six engine speed data are used for effecting the comparison and decision for the speed change.

A step 400 determines whether the ignition event count value has reached a preset number $L_3$ which indicates the end of a dither period. So long as the preset number $L_3$ is not reached, the selection from the RAM 107 of the learning advance angle $\theta_2$ corresponding to the engine operating conditions at the time of the current processing is repeated, but the processing proceeds to a step 401 when the preset number $L_3$ is reached. Usually, the processing of the main routine from the step 1002 to the step 1004 in FIG. 3 is repeated in accordance with the control program. Then, when the CPU 100 receives an ignition timing interruption signal from the interruption control unit 102, even if the main routine is under execution, the CPU 100 immediately interrupts the execution of the main routine and the processing proceeds to the interruption processing routine of a step 1010.

At a step 1011, the CPU 100 inputs from the counter 101 a pulse count T180 which is obtained by the counting at every 180° crank angle and is indicative of the engine speed Ne and also inputs from the analog input port 104 a digital value Pm indicative of the intake pressure, thereby computing and storing the values of Ne and Pm in the RAM 107.

A step 1012 determines whether the ignition event count value n is zero, namely, it is at the start of the dither period (see n in FIGS. 12A and 12B and 15), and the step 1012 branches to YES and proceeds to a step 1013 when it is at the start, while the step 1012 transfers to a step 1014 when it is not at the start. The step 1013 computes, as shown at (3) of FIG. 12B, a number of ignition events $L_1$ indicative of a first clock pulse counting start position, a number of ignition events $L_2$ indicative of a second counting start position, a number of ignition events $L_3$ indicative of the dither terminating position, a number of ignition events $\Delta L$ indicative of first and second clock pulse counting periods and an ignition timing dither quantity $\theta_D$. The step 1013 also sets $Nc_1$ and $Nc_2$ indicative of the number of ignition events in the first and second clock pulse counting periods, respectively, as $Nc_1=\Delta L$ and $Nc_2=\Delta L$, and stores the same in the RAM 107.

Figure 6:
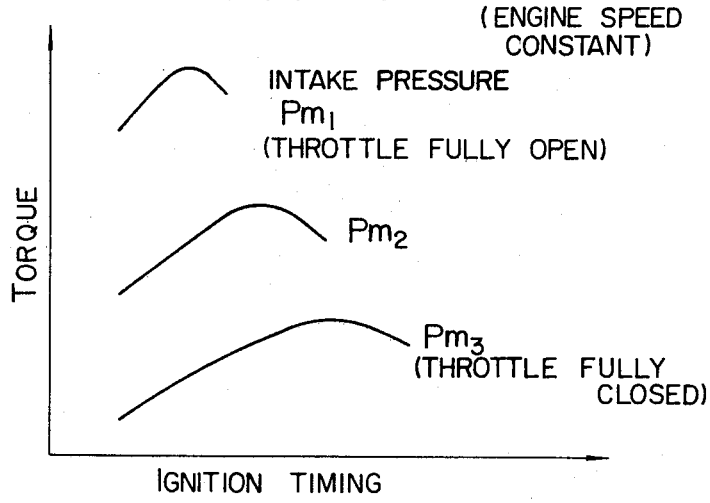
FIG. 6 is a characteristic diagram showing the relation between the output torque and ignition timing.
Figure 7A:
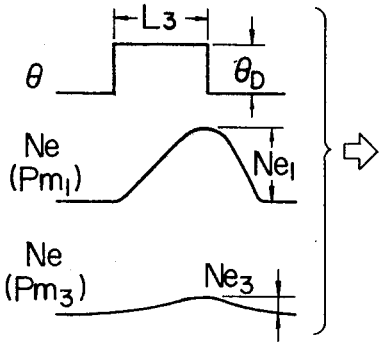
FIGS. 7A and 7B are diagrams showing respectively the manner of the change of the engine speed depending on the dither period.
Figure 7B:
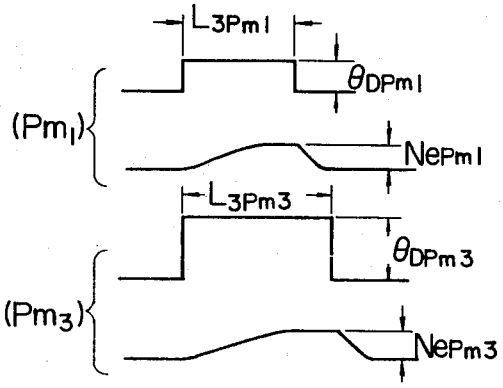

As shown in FIG. 7A, even when the ignition timing $\theta$ is shifted using the same dither quantity $\theta_D$ and dither period $L_3$, the amount of change of the engine speed Ne differs as indicated at $Ne_1$ and $Ne_3$ in FIG. 7A depending on the engine operating condition (here, the intake pressures $Pm_1$ and $Pm_3$ as shown in FIG. 6). Thus, by preselecting dither quantities $\theta_{DPm1}$ and $\theta_{DPm3}$ and dither periods $L_{3Pm1}$ and $L_{3Pm3}$ depending on the engine operating condition as shown in FIG. 7B, the respective resultant changes of the engine speed, $Ne_{Pm1}$ and $Ne_{Pm3}$, assume values which are substantially similar to each other.

Generally, when the engine speed is maintained constant, the relation of the intake pressure (engine load) and the engine torque with the ignition timing becomes as shown in FIG. 6, that is, the torque varies gently with variations in the ignition timing when the intake pressure is low ($Pm_3$) at the fully closed position of the throttle valve, namely, when the load is low, and the slope becomes steeper as the intake pressure increases from $Pm_3$ to $Pm_2$ and $Pm_1$ (as the load increases). As a result, the controllability can be improved if the value of the dither quantity $\theta_D$ is determined by the following equation depending on the engine operating condition:

$$\theta_D=(\theta_B+\theta_2)\times K_1$$

(where $\theta_B$ is a basic ignition timing and $K_1$ is a constant.) By operating the engine with the ignition timing varied on the basis of the dither quantity $\theta_D$ determined by the above equation, it is possible to accurately determine the direction of improving the fuel consumption rate under all engine operating conditions, and also it is possible to keep the engine speed change caused by the dither within a given percentage of the engine speed at the time of the control, thereby preventing deterioration of the driving performance. As regards the positive or negative sign of the dither quantity $\theta_D$ to be determined by the above equation, if the current ignition timing condition is at an advance step shown at (1) of FIG. 12A, which operates the engine at an advanced ignition timing with respect to the computed ignition timing $\theta=\theta_B+\theta_1+\theta_2$ (where $\theta_B$ is a basic ignition timing determined by the current intake pressure and engine speed as shown in FIG. 11), a positive dither quantity $+\theta_D$ is used. While, if it is at a retard step which operates the engine at a retarded ignition timing with respect to the computed ignition timing, a negative dither quantity $-\theta_D$ is used.

Figure 8:
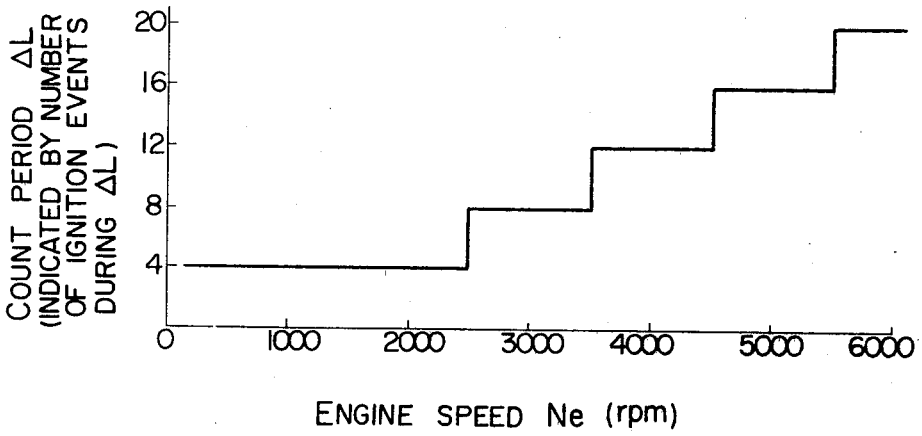
FIG. 8 is a characteristic diagram showing the count period determined in this invention, which varies in accordance with the engine speed.

According to the present invention, the period $\Delta L$ for counting the number of ignition events is changed with the engine speed, and the count period $\Delta L$ is prolonged with an increase in the engine speed as shown in FIG. 8. Further, in the case of a four-cylinder engine an ignition event occurs at every 180° crank angle. Thus, the count period is selected to include an ignition event number which is an integral multiple of the number of cylindres so as to average the combustion conditions of the four cylinders, thereby preventing data dispersion from being caused by the difference in torque, etc. among the respective cylinders.

Then, the comparison engine speed Ns is obtained from the following equation:

$$Ns = \frac{Nc \times K_2}{Cp}$$

where Nc=number of ignition events occurring during clock pulse count period (ΔL), $K_2$=constant of $3.75 \times 10^6$, Cp=number of clock pulses (each thereof having repetition period of 8 μs) occurring during count period.

Figure 9:
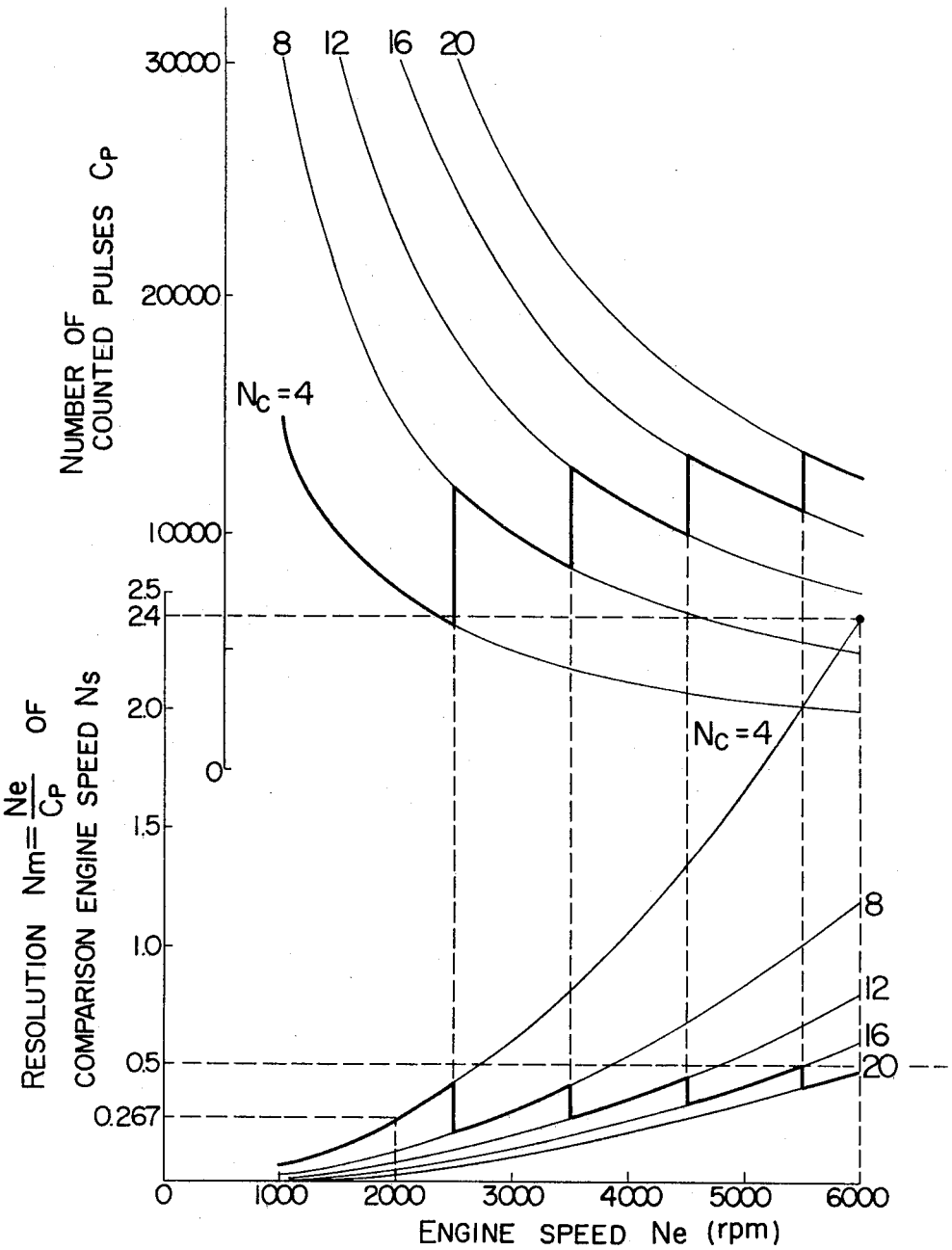
FIG. 9 is a characteristic diagram showing the relation of the number of counted pulses and the resolution of the comparison engine speed versus the engine speed.

FIG. 9 shows the relation of the number of counted pulses Cp and the resolution of Ns versus the engine speed.

According to FIG. 9, if Nc is fixed to 4, for example, the number of counted pulses Cp decreases with an increase in the engine speed. Thus, when Nc=4, the resolution (Nm) of the comparison engine speed Ns given by Nm=Ne/Cp becomes Nm=2.4 rpm at 6,000 rpm as compared with Nm=0.267 rpm at 2,000 rpm. The engine speed changes caused by the dithering of the ignition timing can be detected with higher sensitivity as the value of the resolution decreases, and therefore it is desirable to reduce the value of the resolution as far as possible. On the other hand, the illustration of FIGS. 7A and 7B shows clearly that the changes of the engine speed can be detected more markedly by measuring the comparison engine speed Ns near the end of the dither period $L_3$. The best compromise between the two situation has been sought, and it has been found by experiments that satisfactory results can be obtained by maintaining the resolution Nm substantially at a constant value with respect to the engine speeds. Such a satisfactory characteristic is shown by the thick solid curve in FIG. 9. In this way, the value of the resolution Nm can be maintained to be substantially 0.5 rpm and below.

Figure 10:
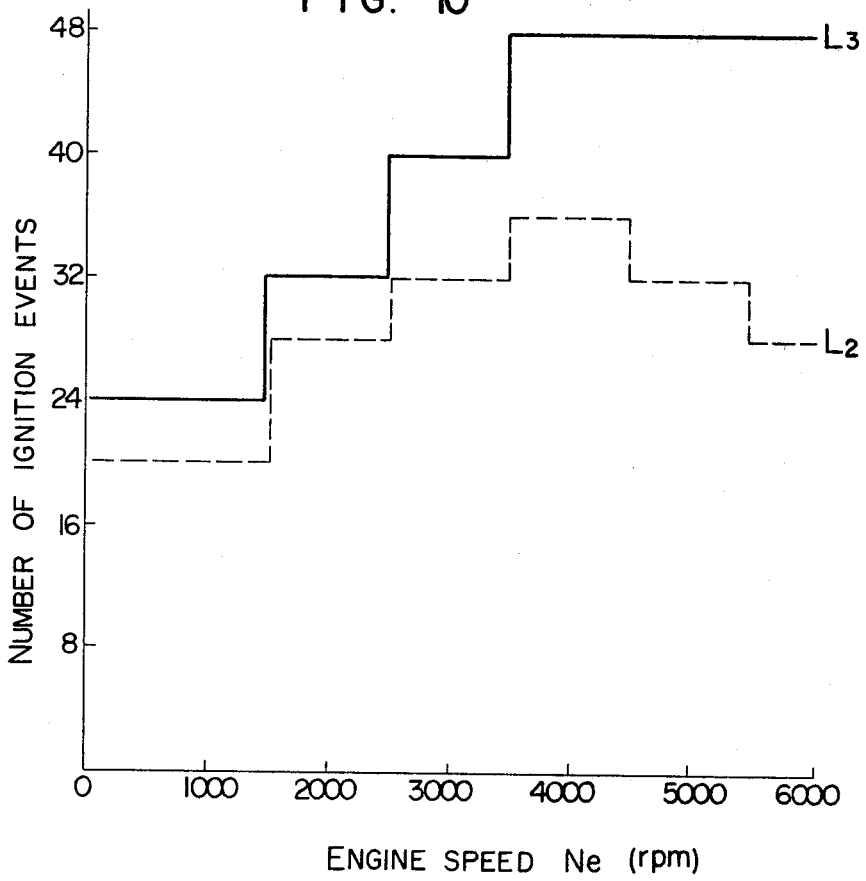
FIG. 10 is a characteristic diagram showing the relation of the dither period indicating ignition events number and the count starting ignition events number versus the engine speed.

FIG. 10 shows the relation of the dither period $L_3$ and the second clock pulse counting start position $L_2$ versus the engine speed Ne. Here, the count period ΔL is given by $\Delta L = L_3 - L_2$.

Returning to the flow chart of FIG. 3, the step 1014 computes the comparison engine speed Ns for each clock pulse count period and stores the same in the RAM 107.

Figure 5:
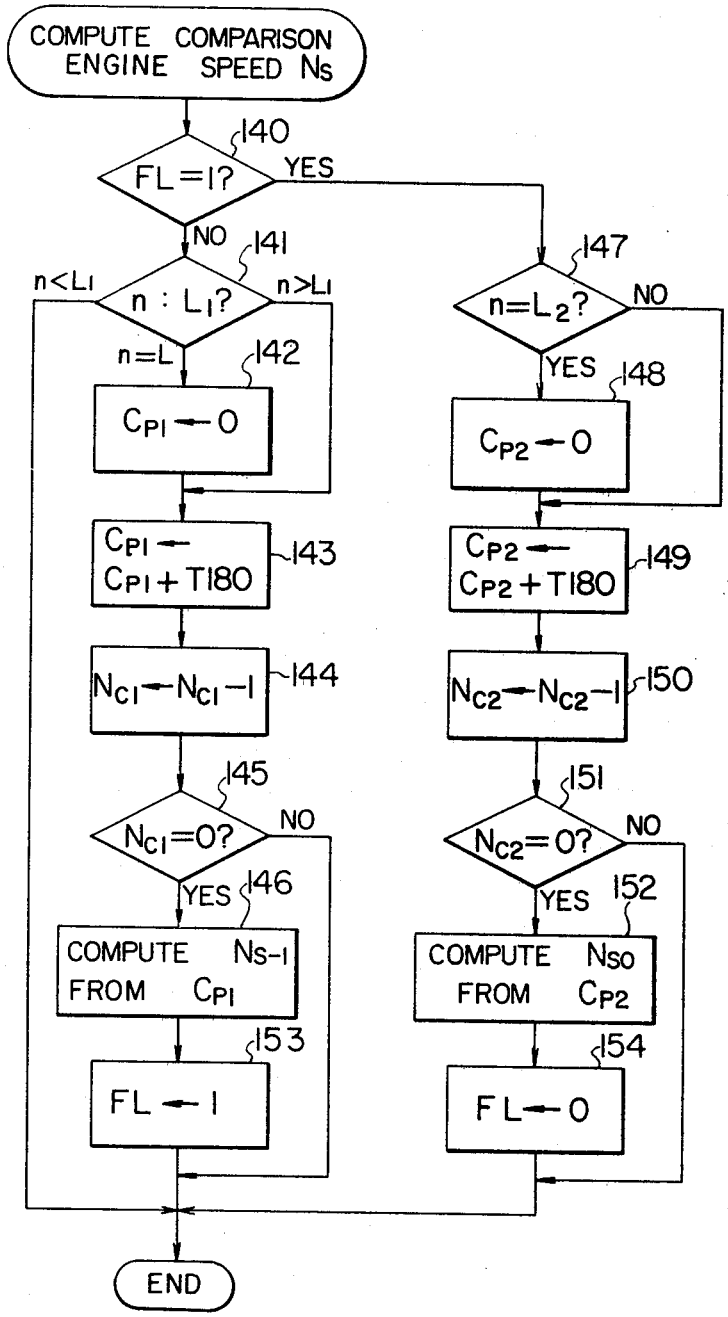

FIG. 5 shows a detailed flow chart for the step 1014 of FIG. 3. The flow chart of FIG. 5 includes the computation procedure used for obtaining a comparison engine speed $N_{s\text{-}1}$ by the first clock pulse count and a comparison engine speed $N_{s\text{-}2}$ by the second clock pulse count during each dither period.

In FIG. 5, a step 140 decides the state of a flag bit which indicates whether the processing should proceed to a process before the first count or to that after the second count. When the flag FL is 1, it indicates that the first count period has been completed. Thus, if the flag FL is not 1 and the first count period has not been completed, the processing proceeds to a step 141. The step 141 compares the ignition event count value n counted from the dither start with the number of ignition events $L_1$, which is indicative of the first counting start position and which has been computed at the step 1013 of FIG. 3. If $n < L_1$ holds, the step 141 transfers to the end without performing any operation and the processing proceeds to a next step 1015 in FIG. 3. If n equals to $L_1$, the processing proceeds to a step 142, where the value of $C_{p1}$ indicative of the number of clock pulses occurring during the count period is reduced to zero. If $n > L_1$ results, then the processing proceeds to a step 143. The step 143 effects addition for giving the sum of the clock pulse counts T180 obtained at every ignition event (or 180° crank angle) after the start of the clock pulse counting and then adds the result of the above addition to the current value of $C_{p1}$. (Where the number of ignition events ΔL indicative of each clock pulse count period is 4, the addition for giving the sum of the clock pulse counts T180 is repeated four times.) A next step 144 confirms the current position of processing in the first count period. Since the setting of $N_{c1} = \Delta L$ has been effected as mentioned before in connection with the step 1013 of FIG. 3, the value of $N_{c1}$ is decreased by 1 each time the addition of the clock pulse count T180 per ignition event is completed at the step 143. A step 145 decides whether the value of $N_{c1}$ has become zero. If it is zero, it is decided that the first count period has come to an end and the step 145 branches to YES. Then, a step 146 computes a comparison engine speed $N_{s\text{-}1}$ from the value of $C_{p1}$ obtained at the step 143 and stores the result in the RAM 107. A next step 153 sets the flag FL to 1 to show the present process is completed, and the processing advances to the next step 1015 of FIG. 3. The computation of the comparison engine speed $N_{s\text{-}1}$ at the step 146 is effected by using the equation $$Ns = \frac{Nc \times K_2}{Cp}$$

which was described in connection with the step 1013 of FIG. 3. If the decision of the step 145 shows that the value of $N_{c1}$ is not zero, it indicates that the addition for obtaining the sum of the clock pulse counts T180 is still in progress, so that the processing proceeds to the step 115 of FIG. 3 without effecting the computation of the comparison engine speed $N_{s\text{-}1}$ at the step 146.

On the other hand, if the step 140 decides that the flag FL equals to 1, it indicates that the first count period has been completed. Thus, the processing proceeds to the process related to the operation of a second count. Thus, the processing proceeds through steps from 147 to 154 shown on the right side in FIG. 5 to effect the computation of a comparison engine speed $N_{so}$ from the second count. Then, the processing proceeds to the step 1015 of FIG. 3. The processing steps used in this case is similar to those used for obtaining the comparison engine speed $N_{s\text{-}1}$ from the first count shown on the left side in FIG. 5, and thus an explanation thereof will be omitted.

The step 1015 of FIG. 3 computes a basic advance angle $\theta_B$ (a theoretical ignition angle value) in accordance with the corresponding values of engine operating parameters, i.e., the engine speed Ne and the intake pressure Pm in this case, in the data map shown in FIG. 11 and stored in the RAM 107.

Then, the processing proceeds to a step 1016 which computes a learning advance angle $\theta_2$ in accordance with the corresponding values of engine operating parameters, i.e., the engine speed Ne and the intake pressure Pm in this case, in a data map stored in the RAM 107. Here, the learning advance angle $\theta_2$ is a correction value for correcting the basic advance angle $\theta_B$ and is obtained as an experimental value or test value by operating the engine, and the data map of the values of the learning advance angles $\theta_2$ has the similar form as the data map of the basic advance angles $\theta_B$ shown in FIG. 11. A step 1017 computes a final ignition angle $\theta$ by the equation $\theta=\theta_B+\theta_1+\theta_2+\theta_D$ using the values of the basic advance angle $\theta_B$, the learning advance angle $\theta_2$, the correction advance angle $\theta_1$ and the dither quantity $\theta_D$. A step 1019 increases the number of ignition event count value n by 1, and a step 1020 returns the processing to the main routine. When the processing returns to the main routine, it returns to the processing step of the main routine which was previously interrupted by the interruption processing.

Then, when the processinq returns to the step 1004 of the main routine, the step 400 in FIG. 4 decides whether the ignition event count value n has reached the preset number $L_3$, and if the ignition event count value n has reached the preset number $L_3$ (i.e., an advance step or retard step has ended), the next step 401 replaces the comparison engine speed values obtained from the first and second counts in the current dither period by N−1 and NO, respectively, the comparison engine speed values obtained from the first and second counts in the preceding dither period by N−3 and N−2, respectively, and the comparison engine speed values obtained from the first and second counts in the last but one dither period by N−5 and N−4, respectively.

Then, the processing proceeds to a step 402 which decides whether the dither quantity $\theta_D$ is positive or negative. Thus, if the comparison engine speeds replaced by N−1 and NO are of the advance step, the step 402 branches to YES. If they are of the retard step, the step 402 branches to NO and proceeds to a step 403. In the case of the retard setp and when the step 402 proceeds to the step 403, the step 403 compares the comparison engine speeds obtained in the current retard step, the preceding advance step and the last but one retard step with one another. If the comparison engine speeds of the retard step are lower than those of the advance step, it is decided that the fuel consumption rate can be improved by advancing the ignition timing and thus the step 403 branches to YES, and then a step 408 corrects the learning advance angle $\theta_2$ preset to correspond to the respective engine operating conditions and stored in the RAM 107 by a learning correction amount $+\theta_3$ and stores the same again in the corresponding location in the RAM 107. If the decision of the step 403 is NO, the step 403 proceeds to a step 404. If conversely the comparison engine speeds of the retard step are higher than those of the advance step, it is decided that the fuel consumption rate can be improved by retarding the ignition timing, and thus the step 404 proceeds to a step 407 where the learning correction amount $\theta_3$ is subtracted from the learning advancing angle $\theta_2$ contrary to the step 408. If the decision of the step 404 is NO, the processing proceeds to a step 409 and the learning advance angle $\theta_2$ is not corrected.

On the other hand, if the decision of the step 402 indicates that the dither quantity $\theta_D$ is positive, that is, the comparison engine speeds currently replaced by N−1 and NO are of the advance step, the step 402 branches to YES and transfers to a step 405 where the same comparison as the step 403 is effected. If the comparison engine speeds of the advance step are lower than those of the retard step, the step 405 branches to YES and transfers to the step 407 where the learning advance angle $\theta_2$ is corrected by subtracting the learning correction amount $\theta_3$ therefrom. If the decision of the step 405 is NO, the step 405 proceeds to a step 406. If the comparison engine speeds of the advance step are higher than those of the retard step, the step 406 branches to YES and proceeds to the step 408 to correct the learning advance angle by adding the learning correction amount $\theta_3$ thereto. In all other cases, the learning advance angle is not corrected. Then, the step 409 initializes or sets the ignition event count value n to zero. Then, as shown in FIG. 3, the processing returns to the step 1002 and the processing of the main routine is repeated.

The manner of controlling the ignition timing as a control variable at the optimum ignition timing for obtaining a maximum torque in accordance with the above-described invention will now be explained with reference to the characteristic diagrams of FIGS. 12A and 12B showing by way of examples the changes with time of the operating conditions of the engine. The characteristic diagram of FIG. 12B illustrates the manner of the control according to the above-described invention in which the optimum ignition timing is obtained from the result of the comparison and decision made on two comparison engine speeds obtained from first and second counts in each of the positive and negative periods in the dithering of the ignition timing. On the other hand, the characteristic diagram of FIG. 12A illustrates the manner of the control by the prior art method shown for the purpose of illustrating the difference in the effect between the optimum ignition timing control method of this invention shown in FIG. 12B and the optimum ignition timing control method of the prior art technique.

The characteristics of the control according to this invention shown in FIG. 12B will be described firstly. Shown at (1) of FIG. 12B is the manner in which the ignition timing is dithered in an advance step (with a dither quantity $+\theta_D$) for operating the engine at an advanced ignition timing and a retard step (with a dither quantity $-\theta_D$) for operating the engine at a retarded ignition timing on the respective sides of a calculated ignition timing $\theta=\theta_B+\theta_1+\theta_2$ and a learning correction amount $\theta_3$ according to the control of this invention is obtained to correct the learning advance angle $\theta_2$ and thereby to adjust the ignition timing $\theta$ at its optimum value. The illustration at (2) of FIG. 12B shows the manner in which the engine speed Ne changes, with (a) showing the state where the ignition timing is not yet controlled at its optimum timing and the magnitude of the change is large and (b) showing the state where the ignition timing is near to its optimum ignition timing. The illustration at (3) of FIG. 12B shows the positions of the ignition event count value n measured from the dither start position (0), with $L_1$ indicating the first clock pulse counting start position, $L_2$ the second clock pulse counting start position and $L_3$ the clock pulse counting end position. The illustration at (4) of FIG. 12B shows the clock pulses during the clock pulse count periods, and that at (5) of FIG. 12B shows the total number of ignition events measured from the dither start position (0). Also shown at (3) of FIG. 12B is the manner in which, as illustrated in FIG. 8, the length of the first and second clock pulse count periods $\Delta L$ ($\Delta L=L_2-L_1=L_3-L_2$) varies in accordance with the engine speed, that is, the count period $\Delta L$ increases with an increase in the engine speed and the former decreases with a decrease in the latter.

The important differences between the control method according to this invention and that according to the prior art technique will now be described by comparing FIG. 12B with FIG. 12A.

In accordance with the prior art control method shown in FIG. 12A, the clock pulses are counted only during a single count period $\Delta L$ from $L_1$ to $L_2$, which are indicative of the ignition event count value n as shown at (3) of FIG. 12A, to obtain a single comparison engine speed for each dither period, i.e., the comparison engine speeds N−2, N−1, NO, N1 an N2 for the respective dither periods. In this prior art control method, considering, for example, the decision made within the either periods from zero to the 112th ignition event in the total number of ignition events shown at (5) of FIG. 12A, if a condition $N-2>N-1<NO$ holds, a correction of $\theta_2 \leftarrow \theta_2+\theta_3$ is effected to advance the ignition timing. If a condition $V-2<N-1>NO$ holds, a correction of $\theta_2 \leftarrow \theta_2-\theta_3$ is effected to retard the ignition timing. In all other cases, no correction is effected. However, this prior art control method is disadvantageous in that when the ignition timing comes near to an optimum ignition timing and the amount of the speed change decreases as seen from the curve of the engine speed Ne shown at (2) of FIG. 12A, the comparison and decision of the comparison engine speeds obtained only at the three points would incur the danger of satisfying the above-mentioned condition of correction even by undesirable factors of disturbance. FIG. 12A shows a state of control where the ignition timing is near to the optimum ignition timing, but the changes of the engine speed due to the undesirable factors of disturbance has caused the condition $N-2>N-1<NO$ to hold and thus an undesired correction has been effected to advance the ignition timing.

With respect to the curves showing the variations of the engine speed Ne at (2) of FIG. 12B, which illustrates the characteristics of the control according to this invention, as mentioned previously, the curve (a) shows the state of the engine speed change where the difference between the optimum ignition timing and the calculated ignition timing is great and a change caused by a factor of disturbance, if any, has a relatively small influence. Thus, it is seen that, in the decision during the same period from zero to the 112th ignition event as in the case of FIG. 12A, the condition of $N-5,N-4>N-3,N-2<N-1,NO$ has been satisfied and a correction of $\theta_2 \leftarrow \theta_2+\theta_3$ has been made to advance the ignition timing. With respect to the curve (b) showing the state where the calculated ignition timing has been corrected to approach its optimum ignition timing, it has been clarified from the mathematical analysis that the probability of causing the condition of $N-5,N-4>N-3,N-2<N-1,NO$ or $N-5,N-4<N-3,N-2>N-1,NO$ to hold by the engine speed change due to any factor of disturbance can be reduced as compared with the case of the prior art control of FIG. 12A. Further, it has also been confirmed by experiments that a possibility of the satisfaction of the above-mentioned conditions of correction is practically zero.

While, in the embodiment described above, the ignition timing is controlled at the optimum ignition timing which provides the maximum engine torque, the control of the air-fuel ratio of an engine can be attained by a similar method to provide the least fuel consumption rate or the maximum output.

Figure 13:
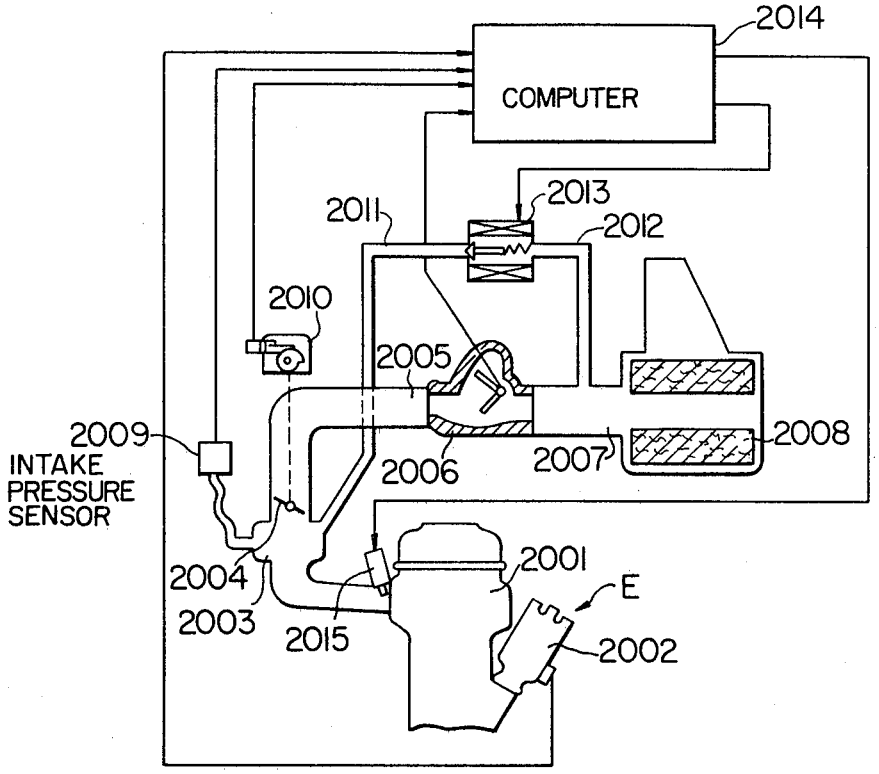
FIG. 13 is a schematic diagram showing the construction of an apparatus for controlling the air-fuel ratio in a second embodiment of this invention.

FIG. 13 shows the construction of another embodiment of this invention for controlling the air-fuel ratio of an engine to provide the least fuel consumption rate.

The air-fuel ratio control apparatus for an engine shown in FIG. 13 comprises an engine body 2001, a rotational angle sensor 2002 incorporated in a distributor, an intake pipe 2003 arranged downstream of a throttle valve 2004, which is operatively linked to an accelerator pedal, and an air flow sensor 2006. The air flow sensor 2006 comprises a baffle plate positioned in an air passage so that the opening degree of the baffle plate changes depending on the amount of air flow, and its output voltage changes in response to the opening degree of the baffle plate thereby making it possible to detect an amount of air flow. The air-fuel ratio control apparatus of FIG. 13 further comprises a downstream air supply pipe 2005 for communication between the air flow sensor 2006 and the throttle valve 2004, an air cleaner 2008, an upstream air supply pipe 2007 for communication between the air flow sensor 2006 and the air cleaner 2008, an intake pressure sensor 2009 for detecting the intake pressure, a throttle sensor 2010 for detecting the fully closed position of the throttle valve 2004 and the opening degree of 60% or more of the throttle valve 2004, a bypass air electromagnetic valve 2013 arranged to bypass the air flow sensor 2006 and the throttle valve 2004, a downstream bypass air pipe 2011 for communication between the bypass air electromagnetic valve 2013 and the intake pipe 2003, an upstream bypass air pipe 2012 for communication between the bypass air electromagnetic valve 2013 and the upstream air supply pipe 2007, and a control computer 2014. The computer 2014 receives output signals from the air flow sensor 2006, the rotational angle sensor 2002, the throttle sensor 2010 and the intake pressure sensor 2009 and computes the quantity of fuel to be injected from an injection valve 2015 at that time in terms of a pulse time width to form an output signal for application to the fuel injection valve 2015.

Figure 14:
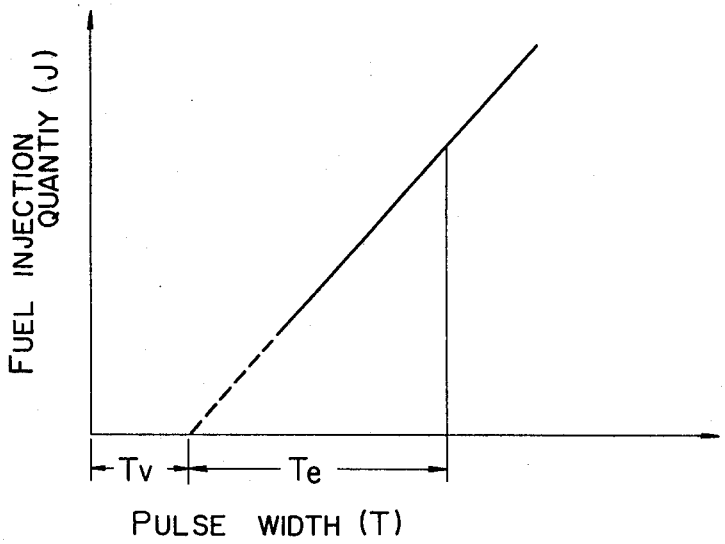
FIG. 14 is a characteristic diagram showing the relation of the fuel injection quantity versus the pulse width applied to the electromagnetic injection valve shown in FIG. 13.

FIG. 14 shows the relation between the fuel injection quantity and the time width of pulses applied to the electromagnetic injection valve 2015 by which the fuel of constant pressure is injected intermittently. The fuel injection quantity J from the injection valve increases linearly with an increase in the width T of the output pulses generated by the computer 2014. In FIG. 14, Tv denotes a valve opening and closing dead time corresponding to the sum of an opening delay time and a closing delay time of the injection valve, and Te denotes the effective portion of the time width of the injection valve controlling pulse.

With the construction described above, when the amount of air flow measured by the air flow sensor 2006 is constant and the amount of fuel flow is constant and when the bypass air is switched on and off by the bypass air electromagnetic valve 2013 thereby changing the air-fuel ratio, the engine speed differs between the cases where there is bypass air supply (namely, when the air-fuel ratio becomes large) and where there is no bypass air supply (namely, when the air-fuel ratio becomes small). Since the direction of the change of the air-fuel ratio which increases the engine speed is the direction of improving the fuel consumption rate, the pulse width T indicative of the fuel injection quantity can be corrected in accordance with the direction in which the engine speed increases.

Figure 15:
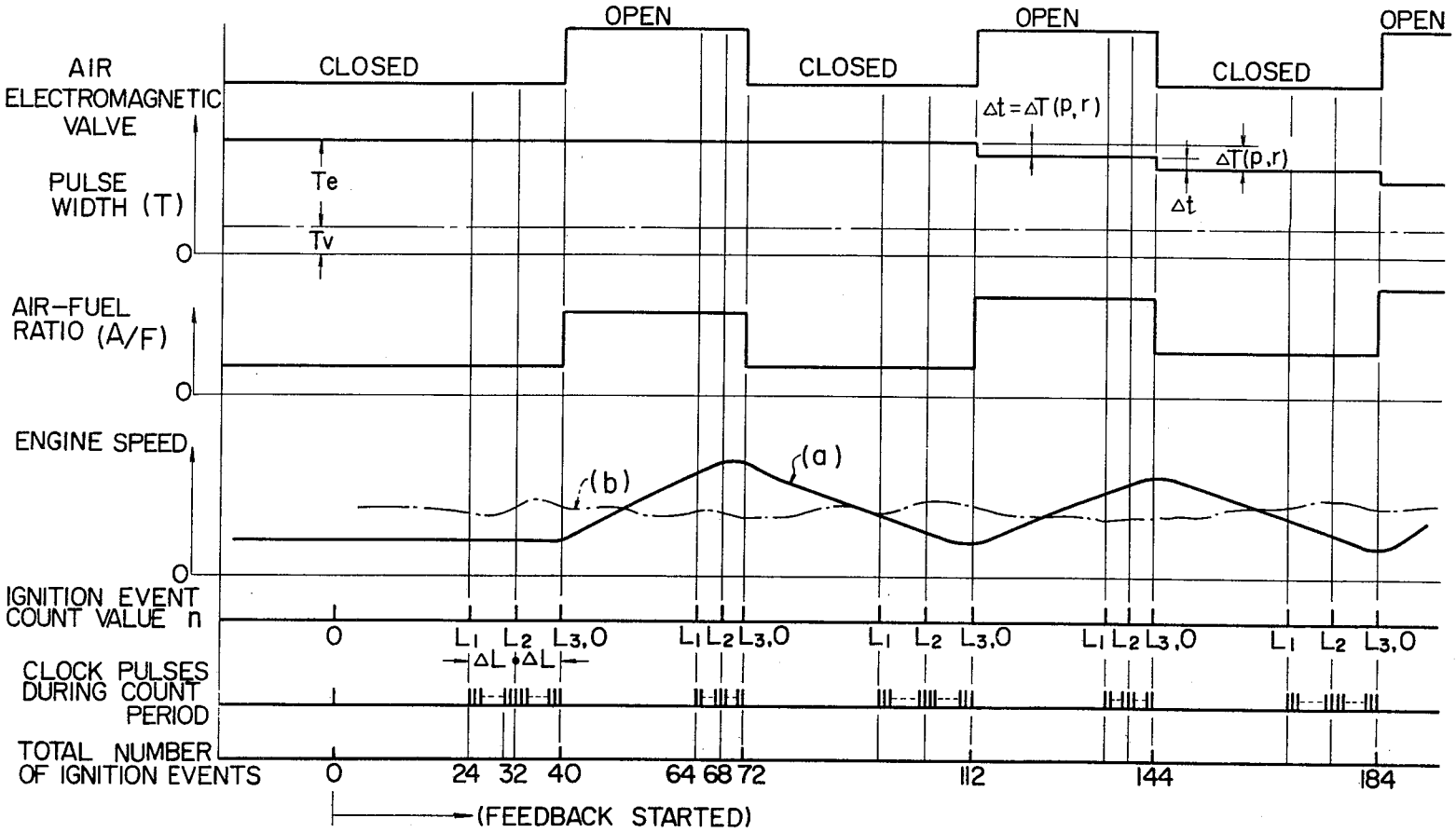
FIG. 15 is a characteristic diagram showing an example of the change with time of the operating condition of the engine subjected to the air-fuel ratio control in this invention.

FIG. 15 shows an example of the change with time of the operating state of an engine under the above-described air-fuel ratio control for obtaining the least fuel consumption rate. In other words, FIG. 15 shows a characteristic diagram of an embodiment of this invention which is applied to the control of the air-fuel ratio of an engine at an optimum value to obtain the least fuel consumption rate by using a control technique similar to that of this invention shown in FIG. 12B which controls the ignition timing at an optimum value for obtaining the maximum output torque. The correction amount $\Delta T(p,r)$ of the pulse width (T) shown in FIG. 15 is given by reading a learning correction pulse width $\Delta T(p,r)$, which is determined by the values of the engine speed Ne and intake pressure Pm in a data map of pulse width correction values similar to the data map shown in FIG. 11, from the corresponding location in the RAM of the control computer 2014 which stores the data map. Also, in FIG. 15, $\Delta t$ denotes an incremental correction amount per one decision which corrects the learning correction pulse width $\Delta T(p,r)$ as the decision is made on the engine speed change, and the value of $\Delta T(p,r)$ corrected by adding or subtracting the incremental correction amout thereto or therefrom, respectively, is stored in the corresponding location in the RAM.

The throttle sensor 2010 is a switch which detects the idling throttle valve position and the throttle valve positions at and around the fully open throttle valve position. The throttle sensor 2010 is used to limit the operating region of the air-fuel ratio control for seeking the least fuel consumption rate to the engine operating conditions other than the idling state and the fully open throttle valve position.

In the like manner as the case described in connection with FIGS. 8 to 10, also in the case of the above-described air-fuel ratio control, it is possible to detect the change of the engine speed with elevated sensitivity by having the count period $\Delta L$ varied as a function of the engine speed, thereby ensuring excellent control performance. Also, in the case of the air-fuel ratio control for seeking the maximum output, the control can be accomplished by varying the amount of fuel flow but with the amount of air flow being maintained constant, and further the same effect as mentioned above can be obtained by varying the count period $\Delta L$ as a function of the engine speed.

While, in the embodiments described above, the operation of comparison and decision is effected by measuring a comparison engine speed twice at every dither period of an engine control variable, it is possible to increase the time of the comparison engine speed measurement at every dither period to be more than three in case of need, and in this case a greater effect can be obtained than in the case of the two measurements. Further, in the above-mentioned case of the two comparison engine speed measurement, the two clock pulse count periods need not be equal to each other and further the two clock pulse count periods may be selected to overlap partially each over the other.

In addition to the above-described optimum control which effects the comparison engine speed measurement twice for each dither period, in the case of controlling the ignition tming at an optimum value to obtain the maximum engine torque, for example, it is possible to effect the correction of the ignition timing only when the magnitude of the engine speed change caused by the dithering of the ignition timing exceeds a predetermined value, thereby preventing the fluctuating variation of the engine speed from occurring when the control has proceeded to the vicinity of the optimum ignition timing. The application of this method has the effect of avoiding any further correction of the ignition timing when the magnitude of the engine speed change has become smaller than the predetemined value, thereby preventing to respond to an engine speed change caused by any factor of disturbance and to effect any undesired correction in the same way as the previously described method and thus making it possible to finish the control operation rapidly.

Figure 16:
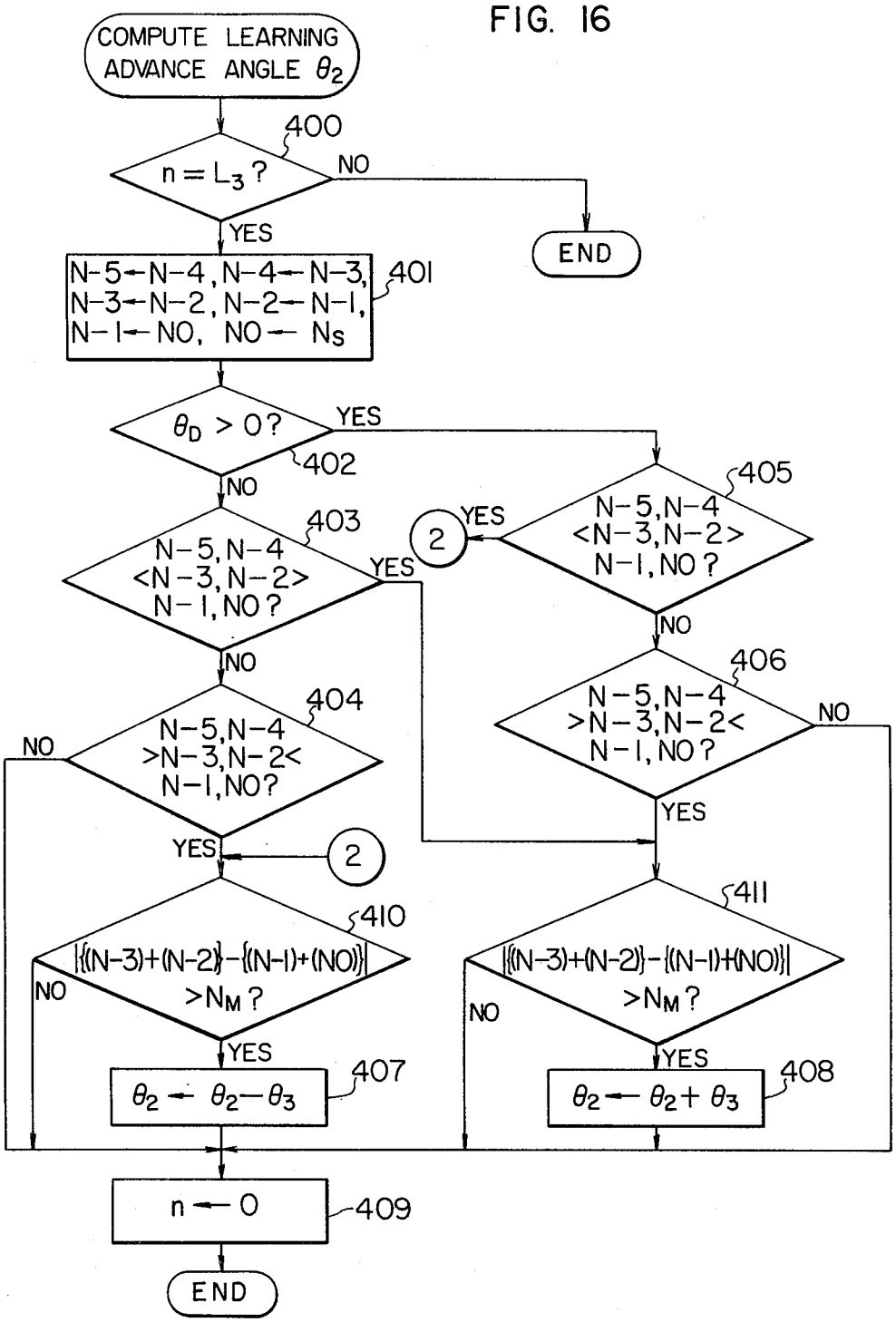
FIG. 16 shows a flow chart corresponding to the flow chart of FIG. 4, which shows the computation procedure for a control operation for correcting the ignition timing only when the amount of the change of the engine speed exceeds a predetermined value.

FIG. 16 shows a flow chart for an embodiment of this invention which corrects the ignition timing only when the amount of the change of the engine speed exceeds a predetermined value. When compared with FIG. 4 showing the flow chart of the processing for the correction of the learning advance angle $\theta_2$ in the previously described optimum control which effects two comparison engine speed measurements for each dither period, the flow chart of FIG. 16 differs therefrom in that it includes the additional steps 410 and 411 used for deciding whether the magnitude of an engine speed change is greater than a predetermined value. Thus, in accordance with the processing of the flow chart shown in FIG. 16, six comparison engine speeds NO, N−1, N−2, N−3, N−4 and N−5 obtained during three consecutive dither periods are compared and decided as to the relative magnitude therebetween so that the learning advance angle $\theta_2$ is corrected at the step 407 or 408 only when the absolute value of the difference between the sum of two comparison engine speeds obtained in the current dither period and that in the preceding dither period is greater than a predetermined positive numerical value $N_M$, but the learning advance angle $\theta_2$ is not corrected when the above-mentioned absolute value of the difference is $N_M$ and below.

As described hereinabove, in accordance with an optimum control method and apparatus for an engine of this invention using the ignition timing of the engine as a control variable for effecting the optimum control with a view to improving the fuel consumption rate or the engine output which: selects at least two ignition timings which are different from each other and are in the vicinity of but are apart by a given amount of ignition timing (dither quantity) from a calculated ignition timing determined in accordance with the operating conditions of the engine; operates the engine at at least two selected ignition timings alternately for a given time period (dither period); detects signals indicative of the engine speeds operated at these ignition timings; compares at least three successive engine speed signals with one another which have been detected while the engine is operated at the at least two selected ignition timings; decides whether the calculated iqnition timing is advanced or retarded with respect to the optimum ignition timing for obtaining the least fuel consumption rate or the maximum output; and corrects the calculated ignition timing in accordance with the result of the decision, there is obtained a remarkable effect of preventing an undesired correction of the ignition timing in response to an engine speed change caused by any factor of disturbance in the vicinity of the optimum ignition timing by detecting the change of the engine speed two or more times for each dither period and deciding on the direction of the change of the engine speed.

Further, in accordance with the present invention the same remarkable effect can be obtained also in the case of the optimum control seeking an optimum value of the air-fuel ratio or fuel supply quantity as a control variable for attaining the same object as that of the above-described optimum control method and apparatus.

Still further, in the above-described optimum control method and apparatus of the present invention it is possible to obtain the same effect by correcting the ignition timing only when the magnitude of an engine speed change caused by the dithering exceeds a predetermined value.

We claim:

1. In an optimum control method for an internal combustion engine comprising the steps of:

calculating a value of one of plural control variables of said engine in response to an operating condition of said engine;

dithering the value of said control variable with a predetermined value from the calculated value of said control variable; operating said engine at the dithered value of said control variable;

detecting a resulting change of a rotational speed of said engine during a predetermined time period;

deciding a direction of changing the value of said control variable toward an optimum value thereof in accordance with a result of said detection;

correcting the value of said control variable in said direction toward the optimum value thereof, the improvement wherein, during each period of the operation of said engine by dithering the value of said control variable, the rotational speed of said engine speed is detected two or more times thereby to decide a direction of the change thereof accurately.

2. A method according to claim 1, wherein said control variable of said engine is an ignition timing.

3. A method according to claim 1, wherein said control variable of said engine is an air-fuel ratio.

4. A method according to any one of claims 1 to 3, wherein the value of said control variable is corrected only when the magnitude of the change of the rotational speed of said engine is greater than a predetermined value.

5. An optimum control apparatus for an internal combustion engine in which said engine is operated by dithering an ignition angle, which is one of plural control variables for operating said engine, from an ignition angle calculated in accordance with detection values of operating parameters of said engine, and a direction of improving an output torque of said engine is decided in accordance with a detected change of an operating condition of said engine thereby correcting said calculated ignition angle in said direction, said apparatus comprising:

ignition means for igniting a mixture gas in said engine;

a rotational angle sensor responsive to the operation of said engine for generating rotational angle signals;

an intake pressure sensor;

microcomputer means; and power supply means;

said microcomputer means comprising input ports for inputting output signals from said sensors, means for receiving the output signal from said rotational angle sensor to generate a signal indicative of engine speeds, processor means, storage means for storing data of basic ignition angles and data of learning advance angles which are determined respectively in accordance with engine speeds and intake pressures of said engine, and energization and ignition control means;

whereby said microcomputer means performs operations including: computing said basic ignition angles, said learning advance angles, a dither quantity, a dither period and a start time of said direction deciding operation; deciding said direction of improving the output torque of said engine in accordance with a change of the engine speed detected during a time period of said direction deciding operation; computing a learning advance angle correction amount in accordance with a result of said direction deciding operation; obtaining a final ignition angle; generating a drive signal for driving said ignition means on the basis of said final ignition angle and supplying said drive signal to said ignition means through said energization and ignition control means; and wherein, during the time period of said direction deciding operation, the engine speed is detected two or more times thereby to decide a direction of the change thereof accurately.

6. An apparatus according to claim 5, wherein said learning advance angle is corrected only when the magnitude of the change of the engine speed exceeds a predetermined value.

7. An optimum control apparatus for an internal combustion engine in which said engine is operated by dithering an air-fuel ratio, which is one of control variables for operating said engine, from an air-fuel ratio calculated in accordance with detection values of operating parameters of said engine, and a direction of improving a fuel consumption rate of said engine is decided in accordance with a detected change of an operating condition of said engine thereby correcting said calculated air-fuel ratio in said direction, said apparatus comprising:

electromagnetic fuel injection valves for supplying injection fuel to said engine;

a rotational angle sensor responsive to the operation of said engine for generating rotational angle signals;

an intake pressure sensor;

a throttle valve;

an intake air pipe for communication between said throttle valve and intake ports of said engine;

an air flow sensor for detecting a rate of air flow supplied to said engine;

a downstream air supply pipe for communication between said air flow sensor and said throttle valve;

an upstream air supply pipe for communication between said air flow sensor and an air cleaner;

a bypass air electromagnetic valve communicating with said upstream air supply pipe through an upstream bypass air pipe and with said intake air pipe through a downstream bypass air pipe, thereby bypassing said air flow sensor and said throttle valve;

microcomputer means; and power supply means;

said microcomputer means comprising storage means for storing data of learning correction pulse time widths, which are used to correct a time width of a drive pulse for driving said electromagnetic fuel injection valves, values of said learning correction pulse time widths being determined in accordance with engine speeds and intake pressures of said engine, and said microcomputer means operating to receive output signals from said air flow sensor, said rotational angle sensor and said intake pressure sensor, to produce engine speeds from an output signal of said rotational angle sensor and intake pressures of said engine from an output signal of said intake pressure sensor, to compute the time width of the drive pulse, to read the learning correction pulse time width from said storage means, to correct the time width of the drive pulse with the read learning correction pulse time width, to supply a corrected drive pulse to said electromagnetic fuel injection valves, to supply a drive signal to said bypass air electromagnetic valve thereby to effect the dithering of the air-fuel ratio, to decide a direction of improving the fuel consumption rate in accordance with a change of the engine speed detected during a time period of said direction deciding operation within a time period of the dithering, and to correct the read learning correction pulse time width in accordance with a result of said direction deciding operation;

wherein, during the time period of said direction deciding operation, the engine speed is detected two or more times thereby to decide a direction of the change thereof accurately.

8. An apparatus according to claim 7, wherein said learning correction pulse time width is corrected only when the magnitude of the change of the engine speeds exceeds a predetermined value.

* * * * *